United States Patent [19]

Harada

[11] Patent Number: 4,608,465

[45] Date of Patent: Aug. 26, 1986

[54] KEYBOARD

[75] Inventor: Yuji Harada, Tokyo, Japan

[73] Assignee: Canon Kabushiki Kaisha, Tokyo, Japan

[21] Appl. No.: 750,999

[22] Filed: Jul. 2, 1985

Related U.S. Application Data

[63] Continuation of Ser. No. 631,018, Jul. 17, 1984, abandoned, which is a continuation of Ser. No. 516,728, Jul. 25, 1983, abandoned.

[30] Foreign Application Priority Data

Aug. 25, 1982 [JP] Japan ..... 57-146181

[51] Int. Cl.[4] ..... H01H 13/70

[52] U.S. Cl. ..... 200/5 A; 200/159 B; 200/308

[58] Field of Search ..... 200/5 A, 159 B, 308

[56] References Cited

U.S. PATENT DOCUMENTS

| | | | |
|---|---|---|---|
| 4,071,718 | 1/1978 | Harden | 200/308 X |
| 4,128,744 | 12/1978 | Seeger | 200/159 B X |
| 4,314,116 | 2/1982 | Gordon | 200/159 B X |
| 4,322,587 | 3/1982 | Burns et al. | 200/159 B X |
| 4,375,585 | 3/1983 | Lee | 200/159 B X |
| 4,492,829 | 1/1985 | Rodique | 200/5 A |

*Primary Examiner*—J. R. Scott

*Attorney, Agent, or Firm*—Fitzpatrick, Cella, Harper & Scinto

[57] ABSTRACT

A keyboard switch has a decoration sheet disposed above a printed circuit board in spaced relation thereto so that a flexible contact disposed between the printed circuit board and the decoration sheet can be moved into and out of contact with the printed circuit board by the depression of the decoration sheet. The decoration sheet is made of a material having a low extensibility, with recessed deforming areas that also serve as key symbols formed integrally with the decoration sheet.

2 Claims, 8 Drawing Figures

KEYBOARD

This application is a continuation of application Ser. No. 631,018 filed July 17, 1984, now abandoned, which is a continuation of application Ser. No. 516,728 filed July 25, 1983, now abandoned.

BACKGROUND OF THE INVENTION

1. Field of the Invention

The present invention relates to a keyboard for electronic equipment, and more particularly to a keyboard switch having a planar switch actuator.

2. Description of the Prior Art

A prior art keyboard switch of this type is shown in FIGS. 1 and 2, and has a main body 1 a decoration sheet 2, a frame 3, and a printed circuit board 4. The decoration sheet 2 and the frame 3 are bonded together by bond 5 as shown in FIG. 2, and the frame 3 and the printed circuit board 4 are fixed to each other by bond or bolts. As shown in FIG. 2, an opening is formed in the frame 3 under a key symbol marked on the decoration sheet 2 and a disc 8 of an elastic metal drawn into a dome shape is disposed in the opening to contact lead terminals 6 which are held in the frame 3. An upper surface of the disc 8 abuts against a projection 7 formed on the lower surface of the decoration sheet 2. A movable contact 9 is formed on the lower surface of the disc 8 and a stationary contact 10 is formed on the printed circuit board 4 below the movable contact 9.

When the upper surface of the key symbol of the decoration sheet 2 is depressed by a finger or an actuating rod in a direction of an arrow shown in FIG. 3, the decoration sheet 2 extends downwardly and the projection 7 presses the disc 8. As a result, the disc 8 is flexed downwardly as shown in FIG. 3. By the flexure of the disc 8, a feeling of a click is imparted and the movable contact 9 contacts the stationary contact 10 of the printed circuit board 4 so that a key input signal corresponding to the key symbol is produced.

In the prior art keyboard switch described above, the switch is actuated by the downward extension of the decoration sheet 2 by the depression. Accordingly, the decoration sheet 2 must be made of a material having a large extensibility. However, since material having large extensibility has a relatively low hardness, the decoration sheet 2 is readily scratched by a nail of a finger or a tip end of a rod when the switch is actuated. Further, because of the requirement of large extensibility, a scope of selection of the material of the decoration sheet is limited. Since the key symbol indicating the key function has to be printed on the decoration sheet, the manufacture of the decoration sheet is time-consuming and expensive.

SUMMARY OF THE INVENTION

It is an object of the present invention to provide a keyboard switch which has an upper decoration sheet made of a hard material having a small extensibility and which enables signals to be keyed in by pressing the decoration sheet.

It is another object of the present invention to provide a keyboard switch which has a decoration sheet having key symbols indicating key functions integrally formed thereon so that the key symbols need not be separately formed.

DETAILED DESCRIPTION OF THE PREFERRED EMBODIMENTS

Figure 1:
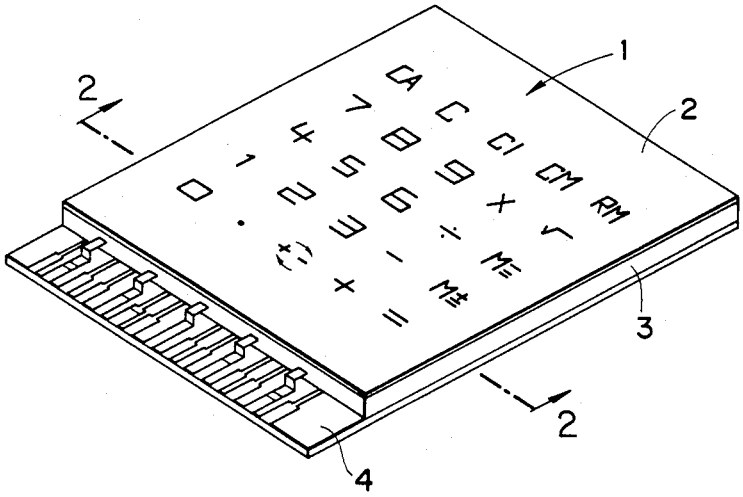
FIG. 1 PRIOR ART
FIG. 1 is an external perspective view of a prior art keyboard switch.
Figure 2:
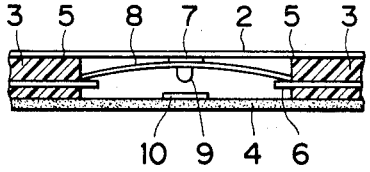
FIG. 2 PRIOR ART
FIG. 2 is a sectional view taken on plane 2—2 in FIG. 1, showing a portion of the structure of the keyboard switch of FIG. 1.
Figure 3:
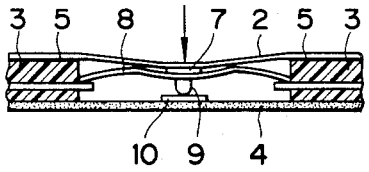
FIG. 3 PRIOR ART
FIG. 3 is a sectional view similar to that of FIG. 2 illustrating an actuated position of the keyboard switch of FIG. 1.
Figure 4:
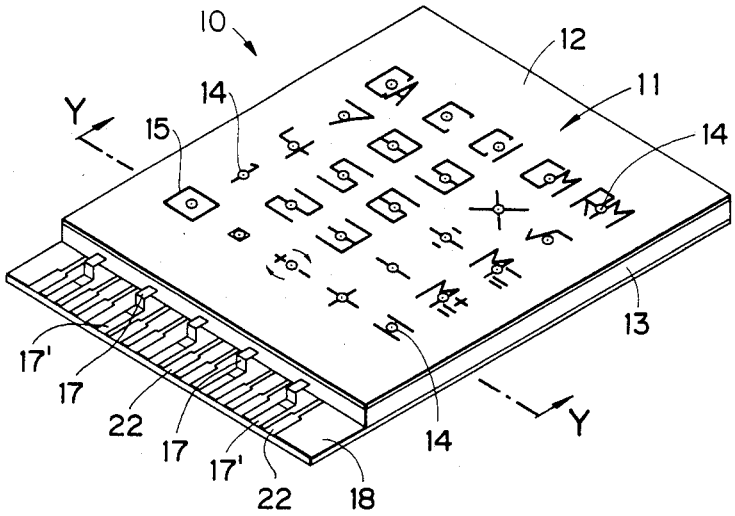
FIG. 4 is an external perspective view of a keyboard switch in accordance with one embodiment of the present invention.
Figure 5:
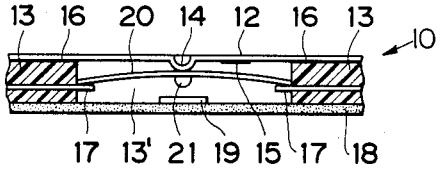
FIG. 5 is a sectional view taken on plane y—y in FIG. 4, showing a portion of the structure of the keyboard switch of FIG. 4.

FIG. 4 shows an external perspective view of one embodiment of the present invention. The keyboard switch 10 of this embodiment includes a main body 11, a decoration sheet 12 made of a synthesized resin material having a small extensibility such as polyester film, polycarbonate film or vinylchloride film, and a frame 13 made of insulative synthesized resin material such as ABS or epoxy. Upwardly or downwardly projecting deforming areas 14 (only the downwardly projecting deforming areas are shown) are formed at predetermined positions of the decoration sheet 12 and key symbols indicating switch functions are printed on the back side of the decoration sheet 12 in the vicinities of the deforming areas 14. An opening 13' is formed in the frame 13 below each deforming area 14 of the decoration sheet 12. The decoration sheet 12 and the frame 13 are registered such that the deforming area 14 is substantially centered at the opening 13', and decoration sheet 12 and frame 13 are fixed to each other by bond 16. Strip leads 17 made of conductive material are held in the frame 13 and first ends thereof project into the opening 13' as shown in FIG. 5 while the second ends thereof extend to ends of a connector of the keyboard switch 10 which are electrically connected to an article of electrical equipment.

Figure 6:
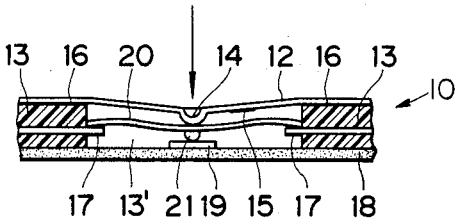
FIG. 6 is a sectional view similar to that of FIG. 5 illustrating an actuated position of the keyboard switch of FIG. 4.

The keyboard switch 10 includes a printed circuit board 18 comprising a substrate such as glass epoxy or paper phenol having a predetermined circuit pattern of a metal foil such as copper or aluminum formed thereon, the printed circuit board 18 being fixed to a lower surface of the frame 13 by bond or bolts. A stationary contact 19 is formed at an end of the circuit pattern at substantially the center of the opening 13' above the printed circuit board 18 and is surface-treated with gold, silver or carbon. A disc 20 made of an elastic metal such as phosphor bronze or stainless steel and drawn into a dome shape is supported on the ends of the strip leads 17 as shown in FIGS. 5 and 6. A protruded movable contact 21 is formed at the center of an inner surface of the disc 20 by drawing the disc 20 or affixing a metal or a conductive rubber piece thereto. As noted the disc 20 is mounted in the opening 13' with the periphery thereof being electrically contacted to the leads 17 as shown in FIG. 5.

The operation corresponding to the keyboard switch described above is now explained. A key of a desired function is selected and the corresponding key symbol 15 on the decoration sheet 12 is depressed by the finger or the actuating rod. Thus, the deforming area 14 on the decoration sheet 12 is deformed and extended by the pressing force so that the decoration sheet 12 over the opening 13' is bent and the decoration sheet 12 is moved by the depression in the direction of an arrow shown in FIG. 6. In the present invention, since the decoration sheet 12 is made of a material having low extensibility, the decoration sheet 12 cannot be fully extended. Instead, the decoration sheet 12 is moved by making use of the deformation and the extension of the deforming area 14 by the depression. By the movement of the decoration sheet 12, the center of the disc 20 is pressed. As a result, the disc 20 is flexed downwardly as shown in FIG. 6 and a click sound is generated by the flexure and a feeling of click is imparted to the finger of the operation. As the decoration sheet 12 is kept depressed, the movable contact 20 on the inner side of the disc 20 is moved downwardly and abuts against the stationary contact 19 on the printed circuit board 18.

Through the contact between the movable contact 21 and the stationary contact 19, a closed electrical circuit which, follows the lead 17, the disc 20, the movable contact 21, the stationary contact 19, the electric circuit on the printed circuit board and a terminal 22 is formed between the terminal 22 and a terminal 17' of the lead 17. As a result, the key input signal of the desired function is inputted to the electronic equipment.

Figure 7:
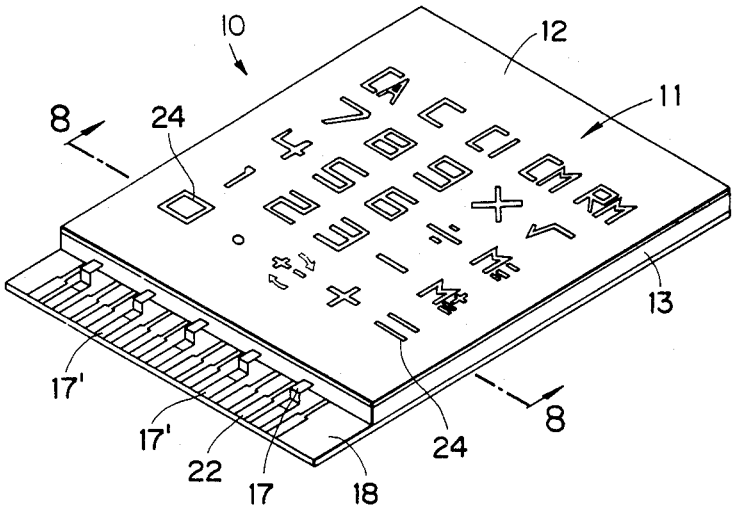
FIG. 7 is an external perspective view of a keyboard switch in accordance with another embodiment of the present invention.
Figure 8:
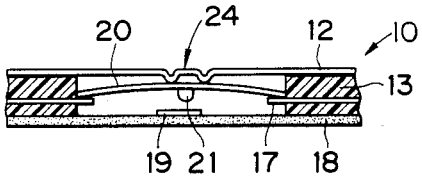
FIG. 8 is a sectional view taken on plane 8—8 in FIG. 7, showing a portion of the structure of the keyboard switch of FIG. 7.

In the above embodiment, the deforming areas 14 are separately formed in the vicinities of the key symbols 15 on the decoration sheet 12. Alternatively, by forming recessed or embossed key symbols 24 integrally with the decoration sheet 12 as shown in FIGS. 7 and 8, the key symbols 24 may function as the deforming areas 14.

As described hereinabove, according to the present invention, the upper decoration sheet may be made of a material having low extensibility and hence scratching of the decoration sheet by the nail of the finger or the actuating rod is effectively prevented and the freedom of selection of the material of the decoration sheet is increased. By forming the recessed or embossed key symbols integrally with the decoration sheet, the key symbols need not be separately printed and manufacture is facilitated.

What I claim is:

1. A keyboard switch comprising:

a printed circuit board including at least one stationary contact disposed on one surface thereof;

spacing means mounted on said one surface of said printed circuit board;

a movable contact mounted with said spacing means in spaced relation to an associated stationary contact for movement theretoward to make electrical connection therewith; and a decoration sheet mounted on said spacing means with each said movable contact lying between said decoration sheet and said printed circuit board, said decoration sheet including an embossed key symbol indicia formed therein in association with each said movable contact so that a click operation takes place about said embossed key symbol indicia when a depressive force is applied thereto to move said associated movable contact into electrical connection with said associated stationary contact.

2. A keyboard switch according to claim 1, wherein said material of low extensibility is selected from the group consisting of polyester film, polycarbonate film and vinylchloride film.

* * * * *

UNITED STATES PATENT AND TRADEMARK OFFICE

CERTIFICATE OF CORRECTION

PATENT NO. : 4,608,465

DATED : August 26, 1986

INVENTOR(S) : YUJI HARADA

It is certified that error appears in the above-identified patent and that said Letters Patent is hereby corrected as shown below:

Column 1, line 16, add comma after "1" (second occurrence); and
line 51, change "a" to --the--.

Column 2, line 14, change "y-y" to --5-5--.

Column 3, line 29, add comma after "circuit";
line 30, delete comma after "which"; and
line 32, add comma after "22".

In the drawings:
Figure 4, change the designation of the sectional line "Y" and "Y" to --5-- and --5--.

Signed and Sealed this

Tenth Day of February, 1987

*Attest:*

DONALD J. QUIGG

*Attesting Officer*

*Commissioner of Patents and Trademarks*